US006251000B1

(12) United States Patent
Murakami et al.

(10) Patent No.: US 6,251,000 B1
(45) Date of Patent: Jun. 26, 2001

(54) SUBSTRATE HOLDER, METHOD FOR POLISHING SUBSTRATE, AND METHOD FOR FABRICATING SEMICONDUCTOR DEVICE

(75) Inventors: Tomoyasu Murakami, Osaka; Katsuyuki Ikenouchi, Toyama; Yuichi Miyoshi, Osaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/398,819

(22) Filed: Sep. 20, 1999

(30) Foreign Application Priority Data

Sep. 24, 1998 (JP) ..... 10-269199

(51) Int. Cl.[7] ..... B24B 41/06

(52) U.S. Cl. ..... 451/364; 451/41; 451/44; 438/431; 438/631; 438/694; 438/695

(58) Field of Search ..... 451/41, 44; 438/431, 438/631, 694, 695

(56) References Cited

U.S. PATENT DOCUMENTS 5,905,298 * 5/1999 Watatani ..... 257/635
5,989,977 * 11/1999 Wu ..... 438/431
5,990,000 * 11/1999 Hong et al. ..... 438/631
5,993,293 * 11/1999 Cesna et al. ..... 451/41
6,008,127 * 12/1999 Yamada ..... 438/694
6,083,852 * 7/2000 Cheung et al. ..... 438/791

FOREIGN PATENT DOCUMENTS 8-339979 12/1996 (JP) .

* cited by examiner

*Primary Examiner*—Joseph J. Hail, III
*Assistant Examiner*—Shantese McDonald
(74) *Attorney, Agent, or Firm*—Eric J. Robinson; Nixon Peabody LLP

(57) ABSTRACT

A substrate holder for holding a substrate to be polished thereon and pressing the substrate against a polishing pad includes a substrate-holding head for holding the substrate thereon and pressing the substrate against the polishing pad. The substrate-holding head is disposed to be vertically movable toward/away from the polishing pad. A pressing member for pressing a peripheral region of the substrate, except for an outer edge region thereof, against the polishing pad is attached to the substrate-holding head.

5 Claims, 15 Drawing Sheets

SUBSTRATE HOLDER, METHOD FOR POLISHING SUBSTRATE, AND METHOD FOR FABRICATING SEMICONDUCTOR DEVICE

BACKGROUND OF THE INVENTION

The present invention relates to a substrate holder for holding a substrate to be polished, such as a semiconductor wafer or a liquid crystal substrate, for use in a chemical/mechanical polishing (CMP) process to planarize the surface of the substrate. The present invention also relates to a method for polishing a substrate by pressing the substrate against a polishing pad and to a method for fabricating a semiconductor device by utilizing the CMP technique.

For the last decade since 1990, the diameters of CMP-processable substrates of various types, such as semiconductor wafers and liquid crystal substrates, have continued to increase. In particular, the diameter of a semiconductor wafer used to be 20-plus centimeters, but has recently reached 30 cm. On the other hand, single-wafer polishing is going to replace multi-wafer polishing day by day. Also, the feature size of a pattern formed on a semiconductor wafer has been drastically reduced over the past few years to 0.5 μm or less. Under the circumstances such as these, it has become more and more necessary to planarize a semiconductor wafer, for example, even more uniformly by the polishing process.

Hereinafter, a conventional substrate polisher for use in a CMP process and a method for polishing a substrate will be described with reference to FIG. 12.

FIG. 12 illustrates an overall arrangement for a conventional substrate polisher. As shown in FIG. 12, a platen 1*a*, made of a rigid material with a flat surface, is attached to the top of a drive shaft 1*b* extending vertically downward from the lower surface of the platen 1*a*. The platen 1*a* and the drive shaft 1*b* are driven by a motor (not shown). An elastic polishing pad 2 is attached to the upper surface of the platen 1*a*. Polishing slurry 4 is supplied through a slurry supply tube 3 during polishing by a predetermined amount.

A substrate holder 100 for holding a substrate 5 to be polished thereon is provided over the polishing pad 2. The substrate 5 is pressed against the pad 2 while being rotated by the substrate holder 100.

In this polisher, the pad 2 is rotated along with the platen 1*a*, while the substrate 5, held by the substrate holder 100, is also rotated and pressed against the pad 2 with the slurry 4 supplied through the slurry supply tube 3 onto the pad 2. As a result, the surface of the substrate 5 to be polished continuously receives pressure from the polishing pad 2 at a certain relative velocity and is polished.

If the surface of the substrate 5 to be polished has some roughness, then such roughness can be reduced through this polishing process and the substrate 5 has its surface planarized. This is because convex portions of the surface are more likely to be polished since the contact pressure between those portions and the pad 2 is relatively high and the relative polishing rate also increases. On the other hand, concave portions thereof are hardly polished because the concave portions hardly come into contact with the polishing pad 2, or should such contact happen, the resulting contact pressure therebetween is relatively low.

As described above, when chemical/mechanical polishing is carried out, the entire surface of a semiconductor wafer should be polished and planarized even more uniformly recently. To meet this demand, a substrate holder such as that disclosed in Japanese Laid-Open Publication No. 8-339979 was proposed.

FIG. 13 illustrates a substrate holder 100A according to a first prior art example disclosed in Japanese Laid-Open Publication No. 8-339979 identified above. As shown in FIG. 13, the substrate holder 100A for holding a substrate 5 to be polished thereon and pressing the substrate 5 against a polishing pad 2 is disposed over the polishing pad 2 attached to the upper surface of a platen 1*a*.

The substrate holder 100A according to the first prior art example includes a drive shaft 101, a disklike substrate-holding head 102, a ringlike seal member 103 made of an elastic body and a ringlike guide member 104. The substrate-holding head 102 is integrated with the drive shaft 101 at the lower end thereof. The seal member 103 is secured to the lower surface of the substrate-holding head 102 in a peripheral region thereof. And the guide member 104 is secured around the outer periphery of the seal member 103 on the lower surface of the substrate-holding head 102. A fluid path 105 runs through the drive shaft 101 and the substrate-holding head 102. Pressurized fluid or air is introduced through the upper end of the fluid path 105, passed through the lower end of the path 105 and then supplied into a space 106, which is formed by the substrate-holding head 102, seal member 103 and substrate 5. The pressurized fluid, which has been supplied into the space 106, presses the substrate 5 against the polishing pad 2. As a result, the substrate 5 is polished.

FIG. 14 illustrates a substrate holder 100B according to a second prior art example. As shown in FIG. 14, the substrate holder 100B includes a drive shaft 101, a disklike substrate-holding head 102, a back pad 108 made of an elastic body and a ringlike guide member 104. The substrate-holding head 102 is integrated with the drive shaft 101 at the lower end thereof. The back pad 108 is secured to the lower surface of the substrate-holding head 102. And the guide member 104 is secured around the outer periphery of the back pad 108 on the lower surface of the substrate-holding head 102. In this configuration, if the pressure inside a fluid path 105, which runs through the substrate-holding head 102, is reduced, then the substrate 5 is held tight on the substrate-holding head 102. On the other hand, if the pressure inside the fluid path 105 is increased, then the substrate 5 is released from the substrate-holding head 102. Also, when the substrate-holding head 102, which is holding the substrate 5 thereon, is pressed against the polishing pad 2, the substrate 5 is polished.

FIGS. 15(*a*) and 15(*b*) illustrate a relationship between the distance from the center of the substrate and the polishing rate where the substrate is polished using the substrate holders according to the first and second prior art examples. As can be seen from FIGS. 15(*a*) and 15(*b*), the polishing rate abruptly increases in the outer edge region of the substrate 5.

The present inventors carried out intensive research to find out why the polishing rate abruptly increased in the outer edge region of the substrate 5 that had been polished using the substrate holders according to the first and second prior art examples. As a result, we reached the following conclusion.

As shown in FIG. 16, during the polishing process of the substrate 5, the substrate-holding head 102 is rotating in the direction as indicated by the arrow B while being pressed downward against the polishing pad 2 as indicated by the arrow A. Accordingly, the polishing pad 2, which is usually made of an elastic body such as foamed polyurethane or a non-woven fabric, receives the forces applied in the respective directions A and B from the substrate 5 and the guide member 104. Thus, portions of the polishing pad 2, which come into contact with the respective outer edges of the substrate 5 and the guide member 104, are likely to form protrusions 2*a* and 2*b*. And the respective regions near the outer edges of the substrate and the guide member 4 receive high pressure as a result of rebounding of the protrusions 2*a* and 2*b* of the polishing pad 2 as indicated by arrows C representing rebounding force in FIG. 16. It is probably because the region near the outer edge of the substrate 5 receives much pressure from the protrusion 2*a* that the polishing rate in the outer edge region of the substrate 5 is a lot higher than that in the center region of the substrate 5.

Thus, a proposed substrate holder includes respective cylinders for pressing the seal and guide members 103, 104 to make the pressure applied to the seal member 103 (and to the outer edge region of the substrate 5) lower than that applied to the guide member 104. In the substrate holder, the pressure applied to the guide member 104 is set higher than that applied to the seal member 103. In this manner, it is possible to prevent the polishing pad 2 from forming the protrusion 2*a* around the outer edge of the substrate 5, thereby equalizing the polishing rate over the entire surface of the substrate 5.

However, if the pair of cylinders for pressing the seal and guide members 103, 104 are provided separately, then two systems of pressurizing mechanisms are needed, thus adversely complicating the structure of the substrate holder.

SUMMARY OF THE INVENTION

An object of the present invention is equalizing a polishing rate over the entire surface of a substrate to polished by making the pressure applied to the outer edge of the substrate lower than that applied to the center region of the substrate using a simple mechanism.

To achieve this object, according to the present invention, a substrate is polished with the peripheral region of the substrate, except for its outer edge region, pressed against a polishing pad.

A substrate holder according to the present invention is adapted to hold a substrate to be polished thereon and to press the substrate against a polishing pad. The holder includes a substrate-holding head for holding the substrate thereon and pressing the substrate against the polishing pad. The substrate-holding head is disposed to be vertically movable toward/away from the polishing pad. The holder further includes a pressing member for pressing a peripheral region of the substrate, except for an outer edge region thereof, against the polishing pad. The pressing member is attached to the substrate-holding head.

The substrate holder according to the present invention includes a pressing member, which is attached to the substrate-holding head, for pressing a peripheral region of the substrate, except for an outer edge region thereof, against the polishing pad. Thus, the outer edge region of the substrate to be polished is not directly pressed by the pressing member. Accordingly, it is possible to prevent the outer edge region of the substrate from receiving high pressure from the polishing pad. In other words, the substrate to be polished can receive substantially equal pressure from the polishing pad over the entire surface thereof, i.e., in both of its center and peripheral regions alike. Therefore, the substrate is polished at a substantially uniform rate over an almost entire surface thereof, thus improving the uniformity in polishing the substrate.

In one embodiment of the present invention, the width of the outer edge region is preferably in the range from 1.5 mm to 3.5 mm.

In such an embodiment, the polishing rate can be substantially uniform in the entire region of the substrate inside a line, which is about 5 mm inner to the outer edge of the substrate. Thus, it is possible to prevent semiconductor chips located in the peripheral region of the semiconductor wafer from causing any failure.

In another embodiment of the present invention, the substrate-holding head is preferably provided with a fluid path such that a pressurized fluid is supplied through one end thereof and drained through the other end thereof. The pressing member may be a seal member secured to such a region of the substrate-holding head as surrounding the other end of the fluid path. A space is preferably formed by the substrate-holding head, the substrate mounted on the polishing pad and the seal member.

In such an embodiment, the peripheral region of the substrate, except for its outer edge region, can be pressed by the seal member. In addition, the center region of the substrate can be pressed by the pressurized fluid that has been supplied through the other end of the fluid path into the space. Accordingly, the substrate is pressed against the polishing pad under a pressure, which is automatically equalized with that applied to the substrate-holding head, in both of its center and peripheral regions alike. As a result, the polishing rate of the substrate can be even more uniform.

In still another embodiment, the pressing member may be a back pad, which is provided on the substrate-holding head so as to face the polishing pad and which is used to press the entire surface of the substrate, except for the outer edge region thereof, against the polishing pad.

In such an embodiment, the substrate can be pressed against the polishing pad with uniform pressure applied to the entire substrate in both of its center and peripheral regions alike. As a result, the polishing rate of the substrate can be even more uniform.

A substrate polishing method according to the present invention is adapted to polish a substrate by pressing it against a polishing pad. The method includes the steps of: a) holding the substrate in such a position as facing the polishing pad; and b) pressing a peripheral region of the substrate held in the step a), except for an outer edge region thereof, against the polishing pad, thereby polishing the substrate.

According to the substrate polishing method of the present invention, the substrate is polished with its peripheral region, except for its outer edge region, pressed against the polishing pad. Thus, the outer edge region of the substrate to be polished is not directly pressed against the polishing pad. Accordingly, it is possible to prevent the outer edge region of the substrate from receiving high pressure from the polishing pad. In other words, the substrate to be polished can receive substantially equal pressure from the polishing pad over the entire surface thereof, i.e., both of its center and peripheral regions alike. Therefore, the substrate is polished at a substantially uniform rate over an almost entire surface thereof, thus improving the uniformity in polishing the substrate.

In one embodiment of the present invention, the width of the outer edge region is preferably in the range from 1.5 mm to 3.5 mm.

In such an embodiment, the polishing rate can be substantially uniform in the entire region of the substrate inside a line, which is about 5 mm inner to the outer edge of the substrate. Thus, it is possible to prevent semiconductor chips located in the peripheral region of a semiconductor wafer from causing any failure.

In another embodiment of the present invention, the step a) preferably includes holding the substrate using a substrate-holding head provided with a fluid path such that a pressurized fluid is supplied through one end thereof and drained through the other end thereof. The step b) preferably include the step of pressing the peripheral region of the substrate, except for the outer edge region thereof, against the polishing pad using a seal member secured to such a region of the substrate-holding head as surrounding the other end of the fluid path. A space is preferably formed by the substrate-holding head, the substrate mounted on the polishing pad and the seal member. Preferably, the step b) further includes the step of pressing a center region of the substrate using the pressurized fluid that has been supplied through the other end of the fluid path into the space.

In such an embodiment, the substrate is pressed against the polishing pad under a pressure, which is automatically equalized with that applied to the substrate-holding head, in both of its center and peripheral regions alike. As a result, the polishing rate of the substrate can be even more uniform.

A first method for fabricating a semiconductor device according to the present invention includes the step of depositing an interlevel insulating film over a surface of a semiconductor wafer as well as over metal interconnection lines formed on the surface of the wafer. The method further includes the step of polishing and planarizing the interlevel insulating film by holding the semiconductor wafer, on which the interlevel insulating film has been deposited, in such a position that the interlevel insulating film faces a polishing pad and then by pressing a peripheral region on the back of the semiconductor wafer, except for an outer edge region thereof, against the polishing pad.

In the first method for fabricating a semiconductor device according to the present invention, the interlevel insulating film is polished and planarized by pressing a peripheral region on the back of the wafer, except for an outer edge region thereof, against the polishing pad. Thus, it is possible to prevent the outer edge region of the interlevel insulating film from receiving high pressure from the polishing pad. In other words, the interlevel insulating film can receive substantially equal pressure from the polishing pad over the entire surface thereof, i.e., in both of its center and peripheral regions alike. Therefore, the interlevel insulating film is polished at a substantially uniform rate over an almost entire surface thereof, thus improving the planarity of the interlevel insulating film over the entire substrate. As a result, various connection failures can be prevented. For example, no contact holes are etched excessively in thinner parts of the interlevel insulating film. In addition, the deformation of contact holes, which often happens in excessively thick parts of the interlevel insulating film, can also be prevented.

A second method for fabricating a semiconductor device according to the present invention includes the step of depositing an insulating film over a surface of a semiconductor wafer so as to fill in trenches formed within the surface of the wafer. The method further includes the step of forming trench isolations out of the insulating film by holding the semiconductor wafer, on which the insulating film has been deposited, in such a position that the insulating film faces a polishing pad and then by pressing a peripheral region on the back of the semiconductor wafer, except for an outer edge region thereof, against the polishing pad such that portions of the insulating film exposed on the surface of the semiconductor wafer are removed.

In the second method for fabricating a semiconductor device according to the present invention, portions of the insulating film that are exposed on the semiconductor wafer are removed by pressing a peripheral region on the back of the semiconductor wafer, except for its outer edge region, against the polishing pad. Thus, it is possible to prevent the outer edge region of the insulating film from receiving high pressure from the polishing pad. In other words, the insulating film can receive substantially equal pressure from the polishing pad over the entire surface thereof, i.e., in both of its center and peripheral regions alike. Therefore, the insulating film is polished at a substantially uniform rate over an almost entire surface thereof, thus improving the planarity of the trench isolations, which are formed out of the insulating film, over the entire substrate. Thus, the trench isolations can be etched to a desired shape over a broad range of the wafer in a subsequent process step, thus attaining excellent electrical characteristics.

A third method for fabricating a semiconductor device according to the present invention includes the step of depositing a metal film over an insulating film, which has been deposited on a surface of a semiconductor wafer, so as to fill in interconnection channels, which have been formed within the insulating film. The method further includes the step of forming buried interconnections out of the metal film by holding the semiconductor wafer, on which the metal and insulating films have been deposited, in such a position that the metal film faces a polishing pad and then by pressing a peripheral region on the back of the semiconductor wafer, except for an outer edge region thereof, against the polishing pad such that portions of the metal film exposed on the insulating film are removed.

In the third method for fabricating a semiconductor device according to the present invention, portions of the metal film that are exposed on the insulating film are removed with a peripheral region on the back of the semiconductor wafer, except for its outer edge region, pressed against the polishing pad. Thus, it is possible to prevent the outer edge region of the metal film from receiving high pressure from the polishing pad. In other words, the metal film can receive substantially equal pressure from the polishing pad over the entire surface thereof, i.e., in both of its center and peripheral regions alike. Therefore, the metal film is polished at a substantially uniform rate over an almost entire surface thereof, thus improving the planarity of the buried interconnections, which are formed out of the metal film, over the entire substrate. Thus, a variation in resistance among the buried interconnections can be reduced, thus attaining excellent device characteristics.

BRIEF DESCRIPTION OF THE DRAWINGS

FIG. 7(*b*) is an enlarged view illustrating the portion A in FIG. 7(*a*).

DESCRIPTION OF THE PREFERRED EMBODIMENTS

Figure 12:
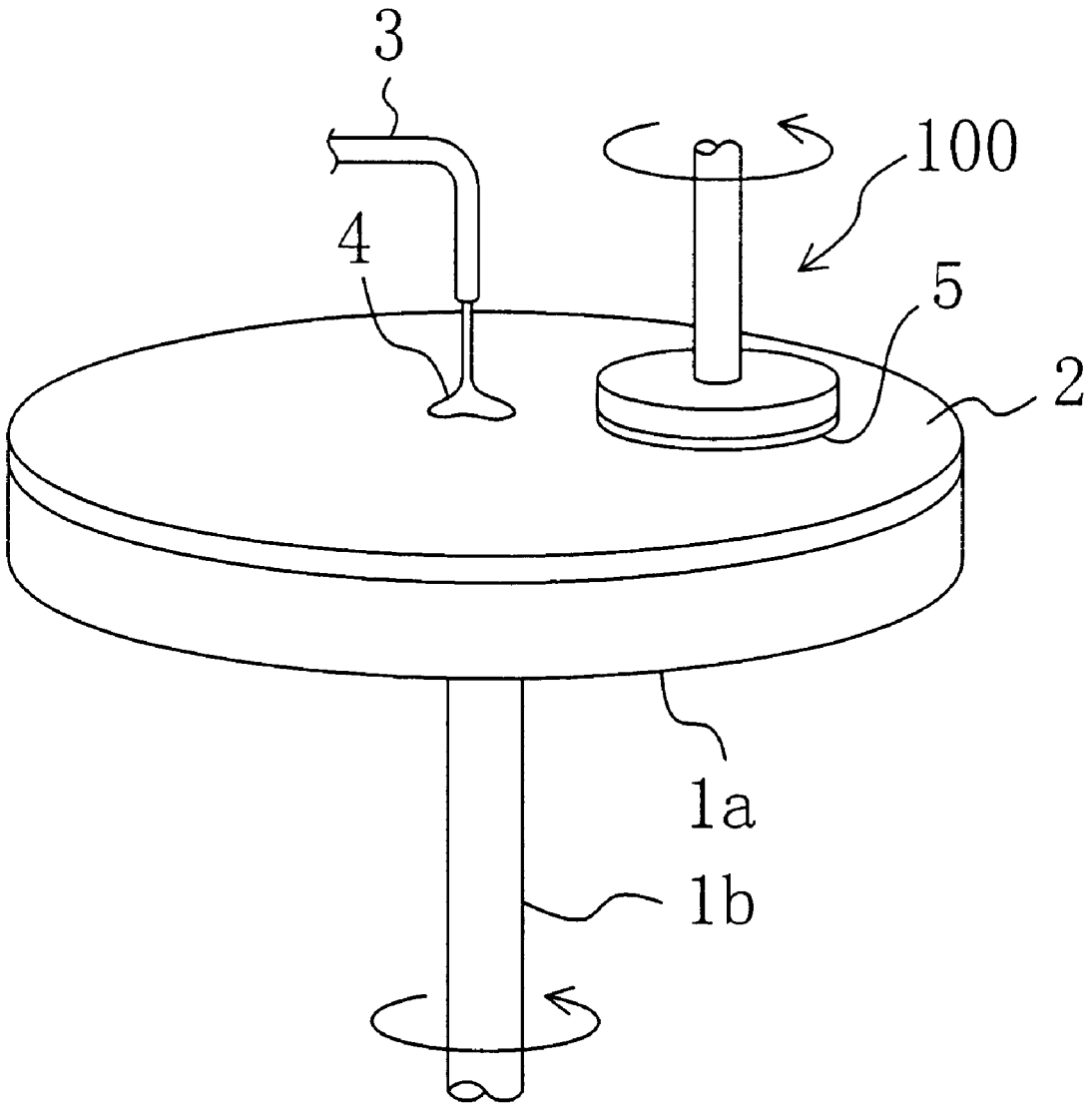
FIG. 12 is a perspective view of a substrate polisher, to which the conventional and inventive substrate holders are applicable.
Figure 13:
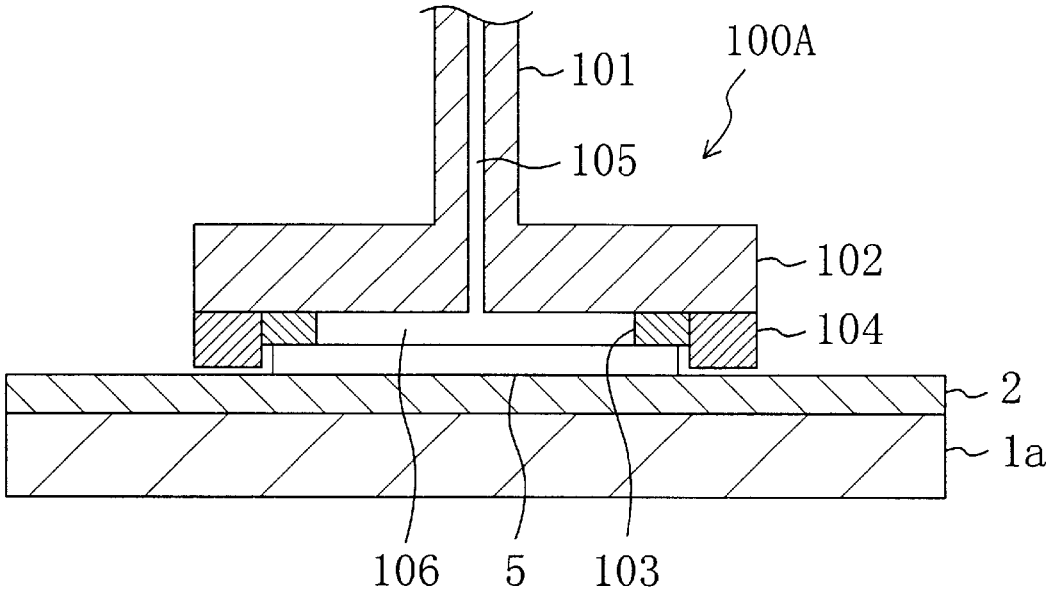
Fig. 13 Prior Art
FIG. 13 is a cross-sectional view of a substrate holder according to a first prior art example.
Figure 14:
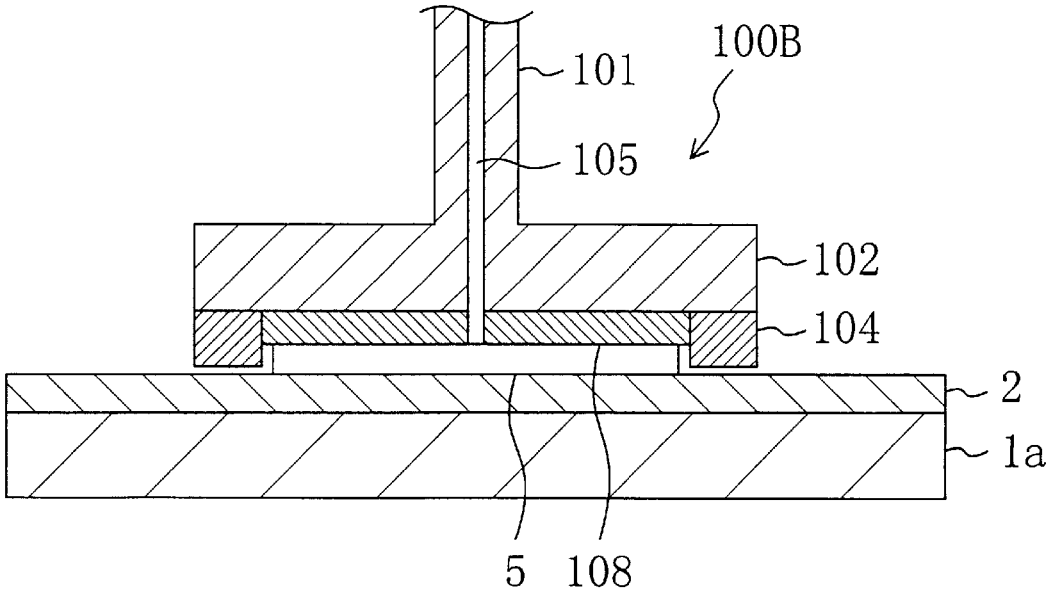
Fig. 14 Prior Art
FIG. 14 is a cross-sectional view of a substrate holder according to a second prior art example.
Figure 15A:
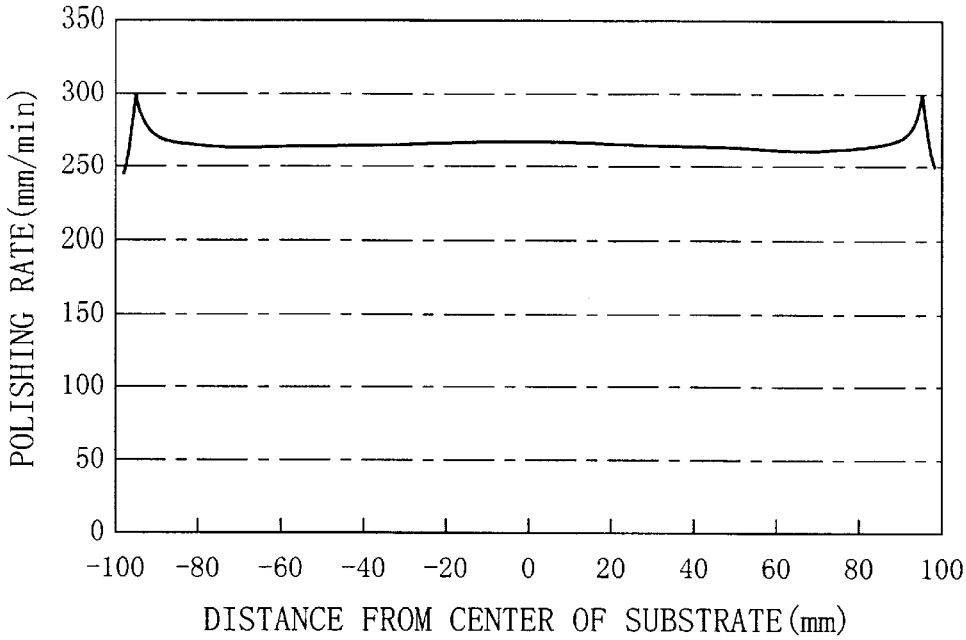
Fig. 15(a) Prior Art
FIGS. 15(*a*) and 15(*b*) are graphs illustrating a relationship between the distance from the center of a substrate and the polishing rate where the substrate is polished using the conventional substrate holder.
Figure 15B:
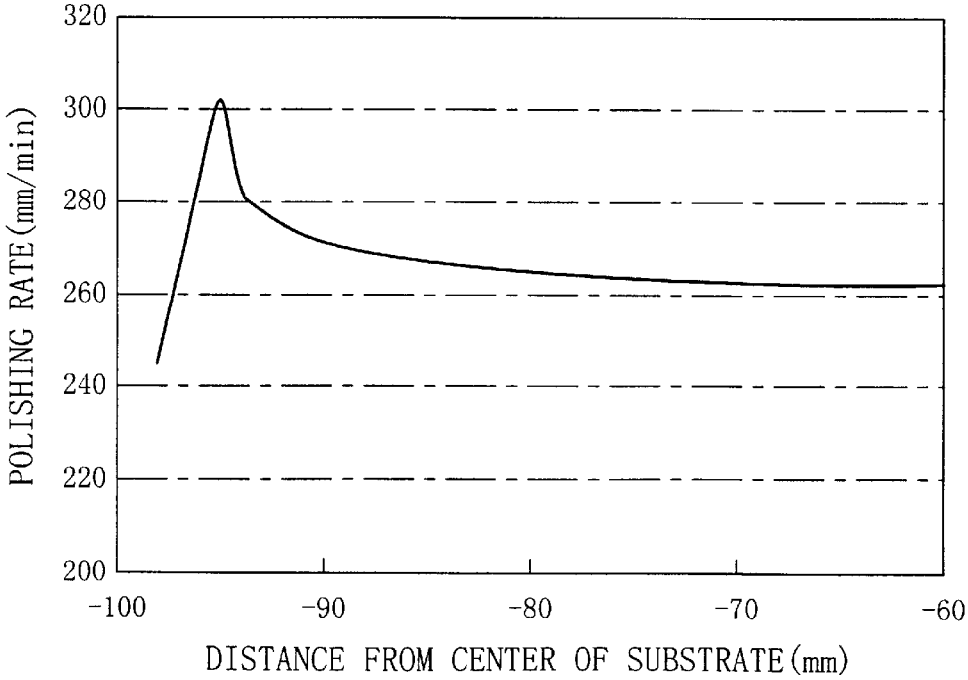
Fig. 15(b) Prior Art
Figure 16:
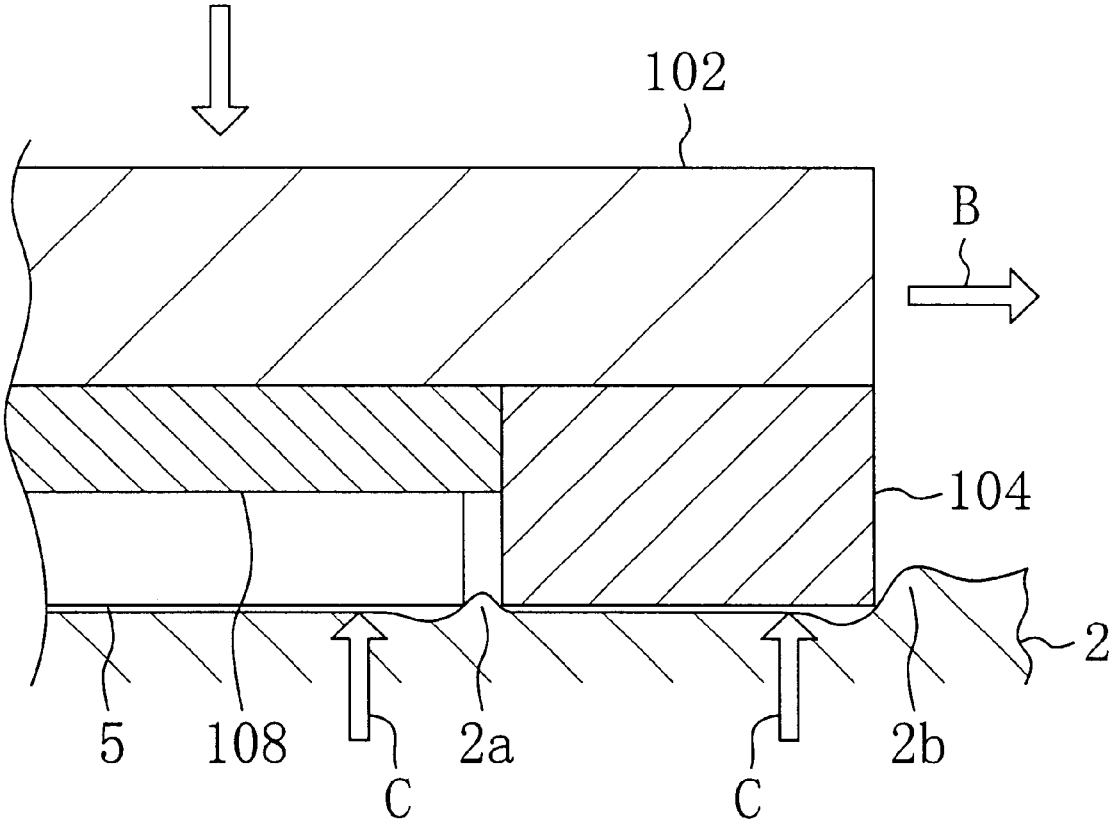
Fig. 16 Prior Art
FIG. 16 is a partially enlarged cross-sectional view illustrating a problem happening when a substrate is polished using the substrate holder according to the second prior art example.

Hereinafter, preferred embodiments of the substrate holer and substrate polishing method according to the present invention will be described with reference to the accompanying drawings. The substrate holder according to every embodiment of the present invention is applicable to the same substrate polisher as that illustrated in FIG. 12, and the description thereof will be omitted herein.

Embodiment 1

Figure 1:
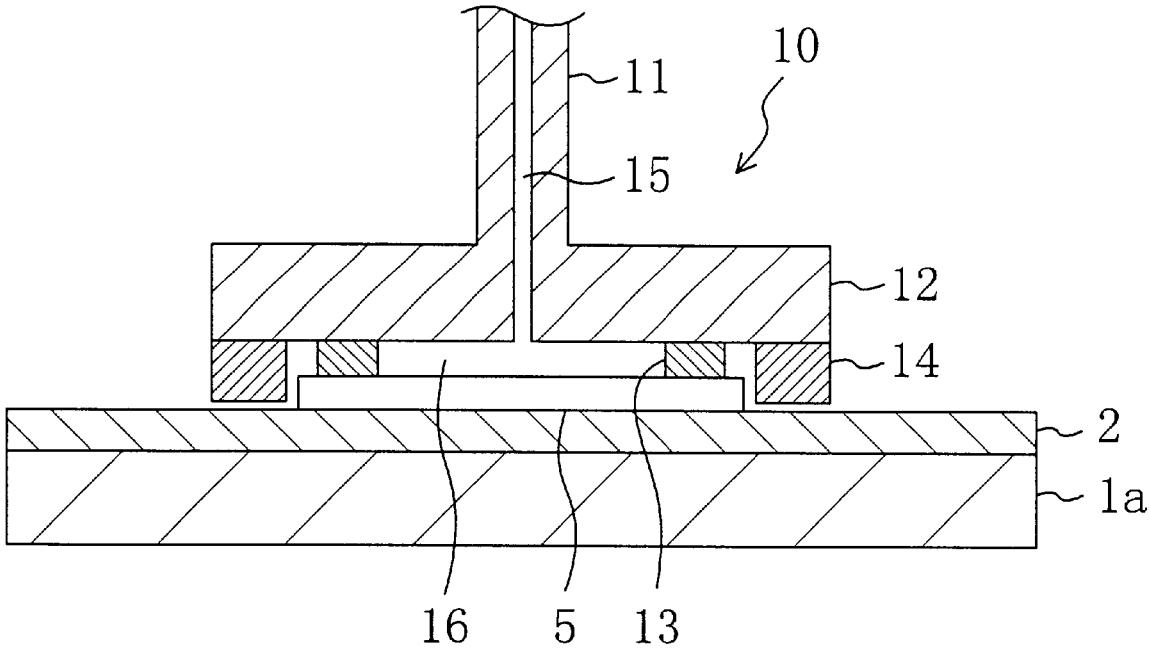
FIG. 1 is a cross-sectional view of a substrate holder according to a first embodiment of the present invention.

FIG. 1 illustrates a cross-sectional structure of a substrate holder 10 according to a first embodiment of the present invention. As shown in FIG. 1, the substrate holder includes a drive shaft 11, a disklike substrate-holding head 12, a ringlike seal member 13 made of an elastic body and a ringlike guide member 14. The substrate-holding head 12 is integrated with the drive shaft 11 at the lower end thereof. The seal member 13 is secured to the lower surface of the substrate-holding head 12 in the peripheral region thereof. And the guide member 14 is secured around the outer periphery of the seal member 13 on the lower surface of the substrate-holding head 12. A fluid path 15 runs through the drive shaft 11 and the substrate-holding head 12. Pressurized fluid or air is introduced through the upper end of the fluid path 15, passed through the lower end of the path 15 and then supplied into a space 16, which is formed by the substrate-holding head 12, seal member 13 and substrate 5. The pressurized fluid, which has been supplied into the space 16, presses the center region of the substrate 5 against a polishing pad 2.

Figure 5:
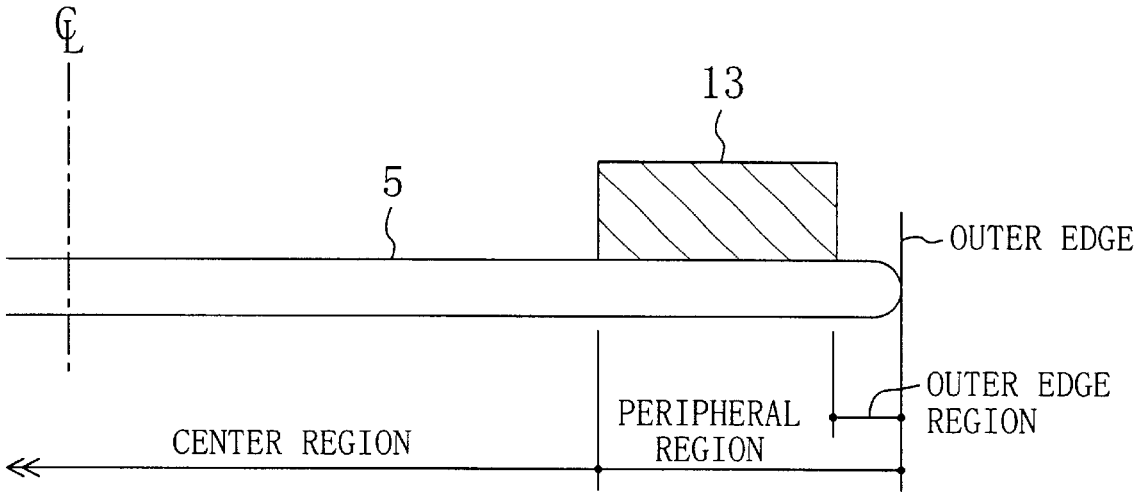
FIG. 5 is a cross-sectional view illustrating a concept of the peripheral and outer edge regions applicable to respective embodiments of the present invention.

According to the first embodiment, the seal member 13 is secured to the lower surface of the substrate-holding head 12 so as to come into contact with the peripheral region of the substrate 5, except for the outer edge region thereof. The peripheral region of the substrate 5, except for its outer edge region, is pressed by the seal member 13 against the polishing pad 2. As shown in FIG. 5, the "peripheral region" of the substrate 5 means in this specification a ringlike region belonging to the surface of the substrate 5 except for the center region thereof, and includes the "outer edge region". The "outer edge region" means a ringlike region, which is located slightly inside the outer edge of the substrate 5 and has a width of several millimeters.

Hereinafter, a method for polishing a substrate using the substrate holder 10 according to the first embodiment will be described with reference to FIGS. 2(*a*) through 2(*c*).

First, a transportation operation will be described. The substrate 5 or substrate holder 10 is moved horizontally over such a distance as to locate the substrate 5 under the substrate-holding head 12. Then, the substrate-holding head 12 is moved downward to come closer to the substrate 5. Thereafter, the air in the space 16 is sucked through the fluid path 15. As a result, the substrate 5 is sucked to, and held on, the substrate-holding head 12 via the seal member 13 as shown in FIG. 2(*a*). The substrate-holding head 12 is transported in such a state to be located over the polishing pad 2 that has been attached to the upper surface of the platen 1*a*.

Figure 2A:
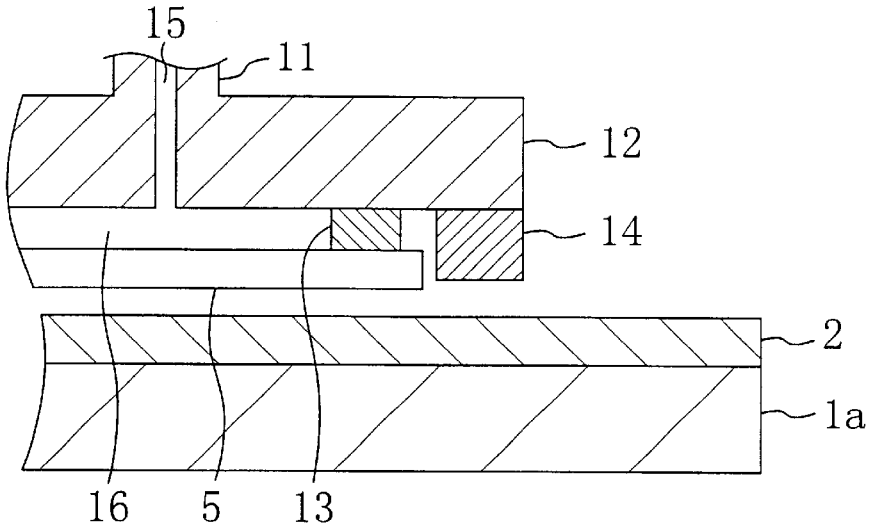
FIGS. 2(*a*), 2(*b*) and 2(*c*) are cross-sectional views illustrating respective process steps for polishing a substrate using the substrate holder according to the first embodiment.
Figure 2B:
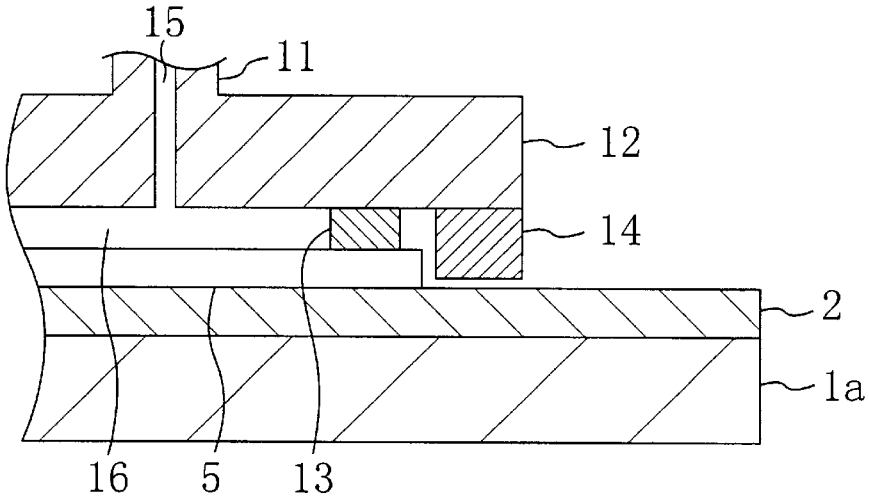
Figure 2C:
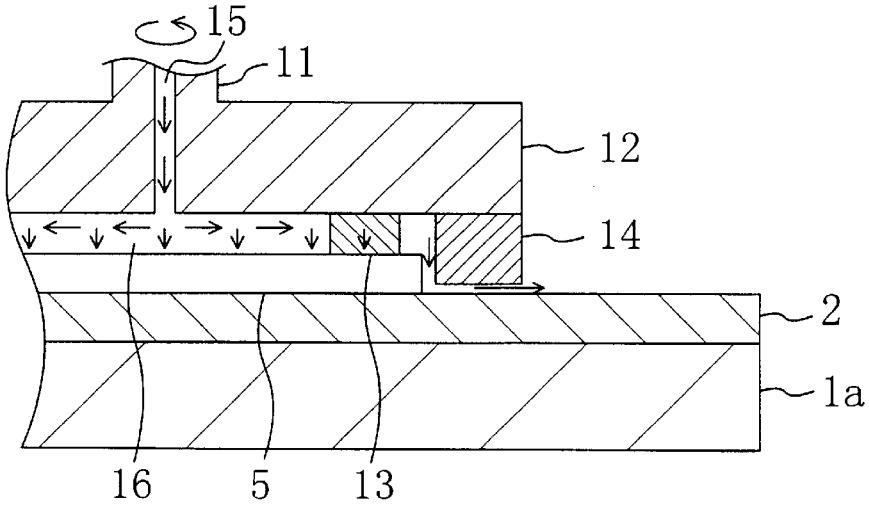

Next, as shown in FIG. 2(*b*), the pressure inside the space 16 is restored to the atmospheric pressure, thereby releasing and mounting the substrate 5 onto the polishing pad 2. Then, the drive shaft 11 and substrate-holding head 12 are pressed downward. As a result, the seal member 13 receives pressure from the polishing pad 2 via the substrate 5 so as to be deformed, and the substrate 5 is held on the substrate-holding head 12 inside the guide member 14.

Subsequently, as shown in FIG. 2(*c*), the substrate-holding head 12 is pressed downward. At the same time, a pressurized fluid, such as pressurized air or nitrogen, is supplied at 800 g/cm$^2$, for example, through the fluid path 15 into the space 16 that has been formed by the substrate-holding head 12, seal member 13 and substrate 5. For instance, if a silicon substrate 5 with a diameter of 8 inches is polished by pressing the substrate 5 against the polishing pad 2 at a pressure of 500 g/cm$^2$, then the pressure applied to the substrate-holding head 12 should be 157 kg. In this state, slurry, containing abrasive grains, is dripped onto the polishing pad 2, while the polishing pad 2 and substrate-holding head 12 are rotated relative to one another. Then, sliding friction is caused between the surface of the substrate to be polished and the polishing pad 2 through the slurry. As a result, the surface of the substrate 5 to be polished has its roughness reduced little by little, and is finally planarized. The guide member 14 is used to prevent the substrate 5 from being ejected due to the centrifugal force involved with the rotation, thereby holding the substrate 5 in a predetermined position. The pressurized fluid, which has been supplied through the fluid path 15 into the space 16, presses the substrate 5 downward from its back surface against the polishing pad 2. However, the substrate 5 is not secured to the seal member 13. Thus, the pressurized fluid supplied into the space 16 may leak out as shown in FIG. 2(*c*) through the gap between the substrate 5 and guide member 14 depending on the rotational state of the substrate 5 or the ruggedness on the back thereof during the polishing process.

As described above, the pressure of the pressurized fluid supplied through the fluid path 15 into the space 16 is higher than the pressure applied to the drive shaft 11. Accordingly, if the gap between the substrate 5 and guide member 14 is about 0.1 mm, then the pressure of the pressurized fluid pushes the substrate-holding head 12 upward, thereby creating a gap between the substrate 5 and seal member 13. As indicated by the arrows in FIG. 2(*c*), the pressurized fluid passes through the gap between the substrate 5 and seal member 13 and then leaks out from under the guide member 14. As a result, the pressure inside the space 16 drops. Since the pressure of the pressurized fluid inside the space 16 is automatically equalized with the pressure applied to the substrate-holding head 12, the substrate 5 is pressed against the polishing pad 2 with a substantially constant pressure.

According to the first embodiment, the seal member 13 is secured to the lower surface of the substrate-holding head 12 so as to come into contact with the peripheral region of the substrate 5 except for the outer edge region thereof. That is to say, the outer edge region of the substrate 5 is not directly pressed by the seal member 13. Thus, it is possible to prevent the outer edge region of the substrate 5 from receiving excessively high pressure from the polishing pad 2.

Also, the center region of the substrate 5 is pressed against the polishing pad 2 with the pressure of the pressurized fluid supplied to the space 16, which is automatically equalized with the pressure applied to the substrate-holding head 12. On the other hand, the peripheral region of the substrate 5, except for its outer edge region, is pressed by the seal member 13 against the polishing pad 2 upon the application of a pressure to the substrate-holding head 12.

Accordingly, the substrate 5 receives substantially equal pressure from the polishing pad 2 over the entire surface thereof, i.e., in both of its center and peripheral regions alike. As a result, virtually the entire surface of the substrate is polished at a substantially uniform rate.

Figure 6A:
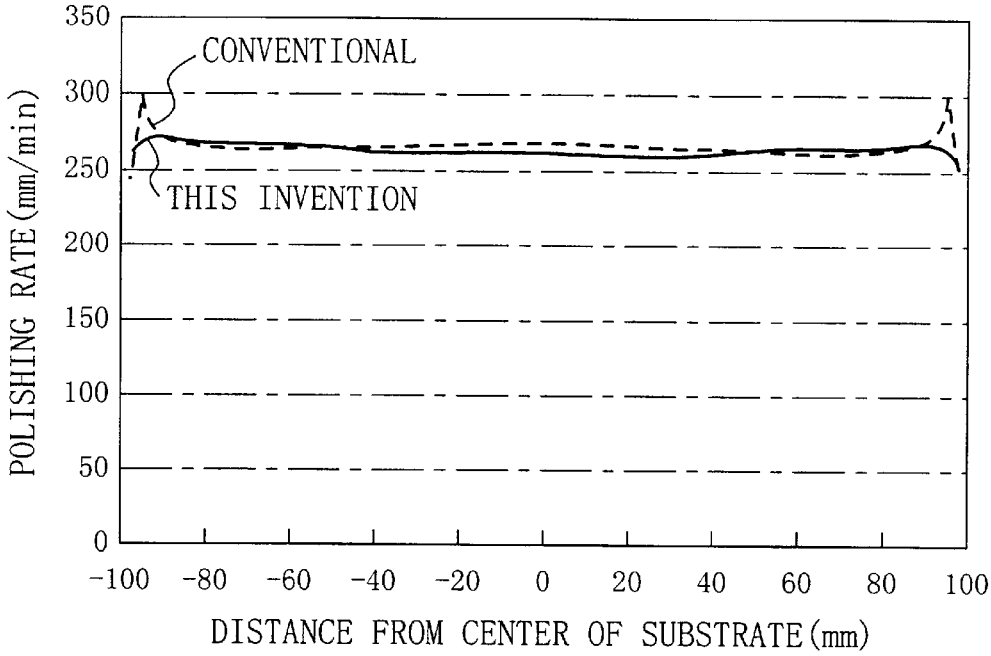
FIGS. 6(*a*) and 6(*b*) are graphs illustrating relationships between the distance from the center of a substrate and the polishing rate where the substrate is polished using the conventional and inventive substrate holders.
Figure 6B:
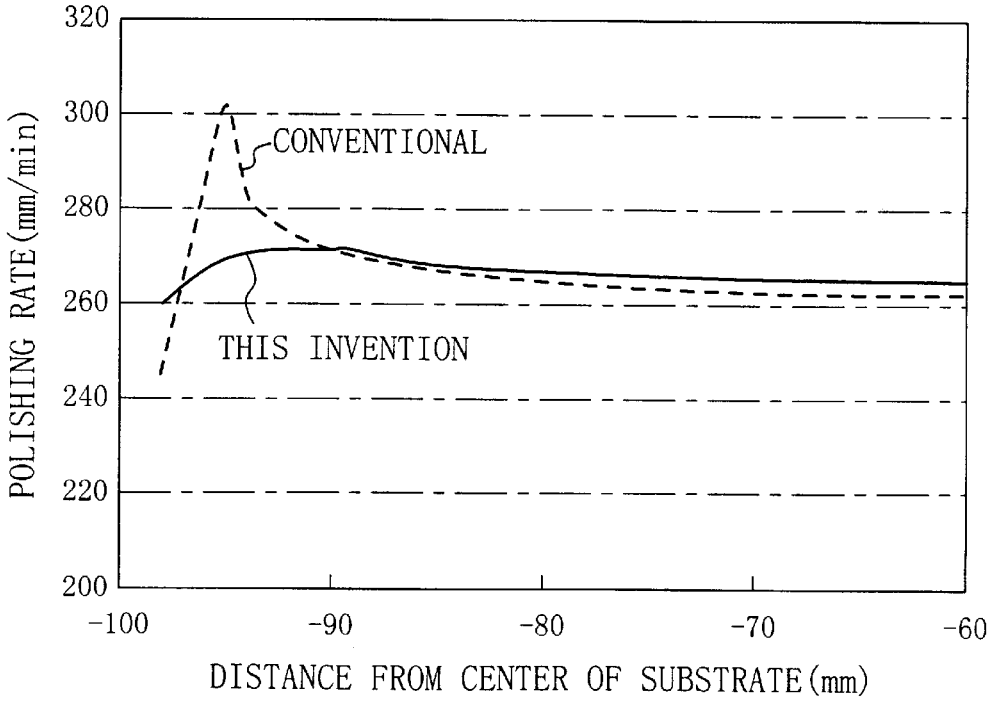

FIGS. 6(*a*) and 6(*b*) illustrate relationships between the distance from the center of the substrate 5 and the polishing rate where the substrate 5 is polished using the conventional and inventive substrate holders. In FIGS. 6(*a*) and 6(*b*), the solid lines represent the results according to the present invention, while the dashed lines represent the results according to the conventional technique. As can be seen from FIGS. 6(*a*) and 6(*b*), virtually the entire surface of the substrate 5 is polished at a substantially uniform rate.

Figure 7A:
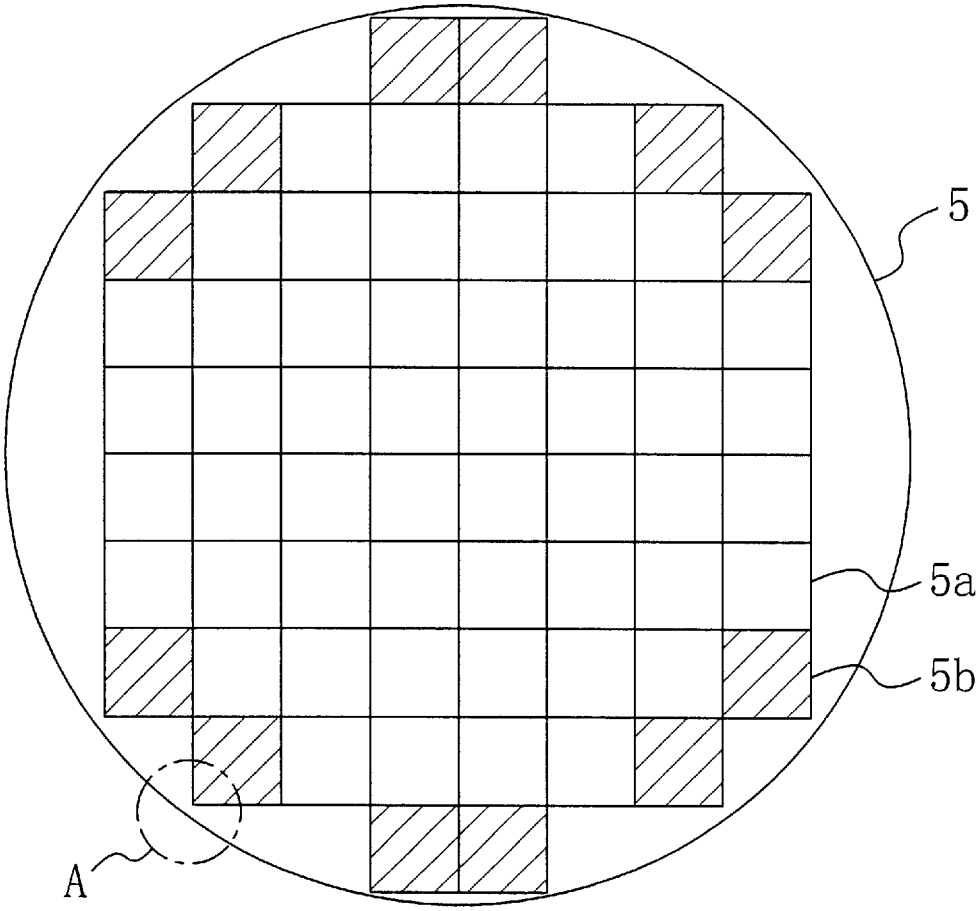
FIG. 7(*a*) is a plan view illustrating an arrangement of semiconductor chips formed on a circular semiconductor wafer as an exemplary substrate.
Figure 7B:
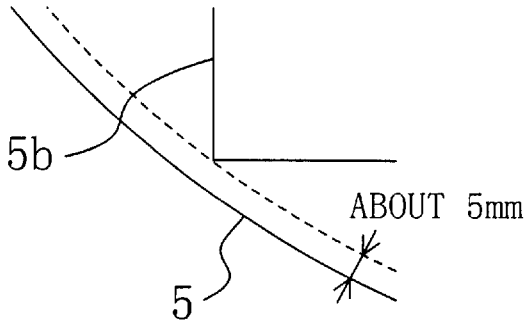

FIG. 7(*a*) illustrates an arrangement of semiconductor chips 5*a*, 5*b* formed on a circular semiconductor wafer as an exemplary substrate 5. The semiconductor chips 5*a* (illustrated as open squares), which are located in the center region of the wafer 5, are not adversely affected even if the polishing rate has abruptly increased in the peripheral region of the wafer 5. The semiconductor chips 5*b* (illustrated as hatched squares), which are located in the peripheral region of the wafer 5, are adversely affected if the polishing rate has abruptly increased in the peripheral region of the wafer 5. FIG. 7(*b*) is an enlarged view illustrating the portion A in FIG. 7(*a*). As shown in FIG. 7(*b*), the distance between the corner of one of the semiconductor chips 5*b* located in the peripheral region of the wafer 5 and the outer edge of the wafer 5 is about 5 mm. Thus, if the polishing rate is substantially constant in a region of the wafer 5 inside the broken line about 5 mm inner to the outer edge of the wafer 5, i.e., if the variation in polishing rate is within 10%, none of the semiconductor chips 5*b*, which are located in the peripheral region of the wafer 5, causes failure.

Figure 8:
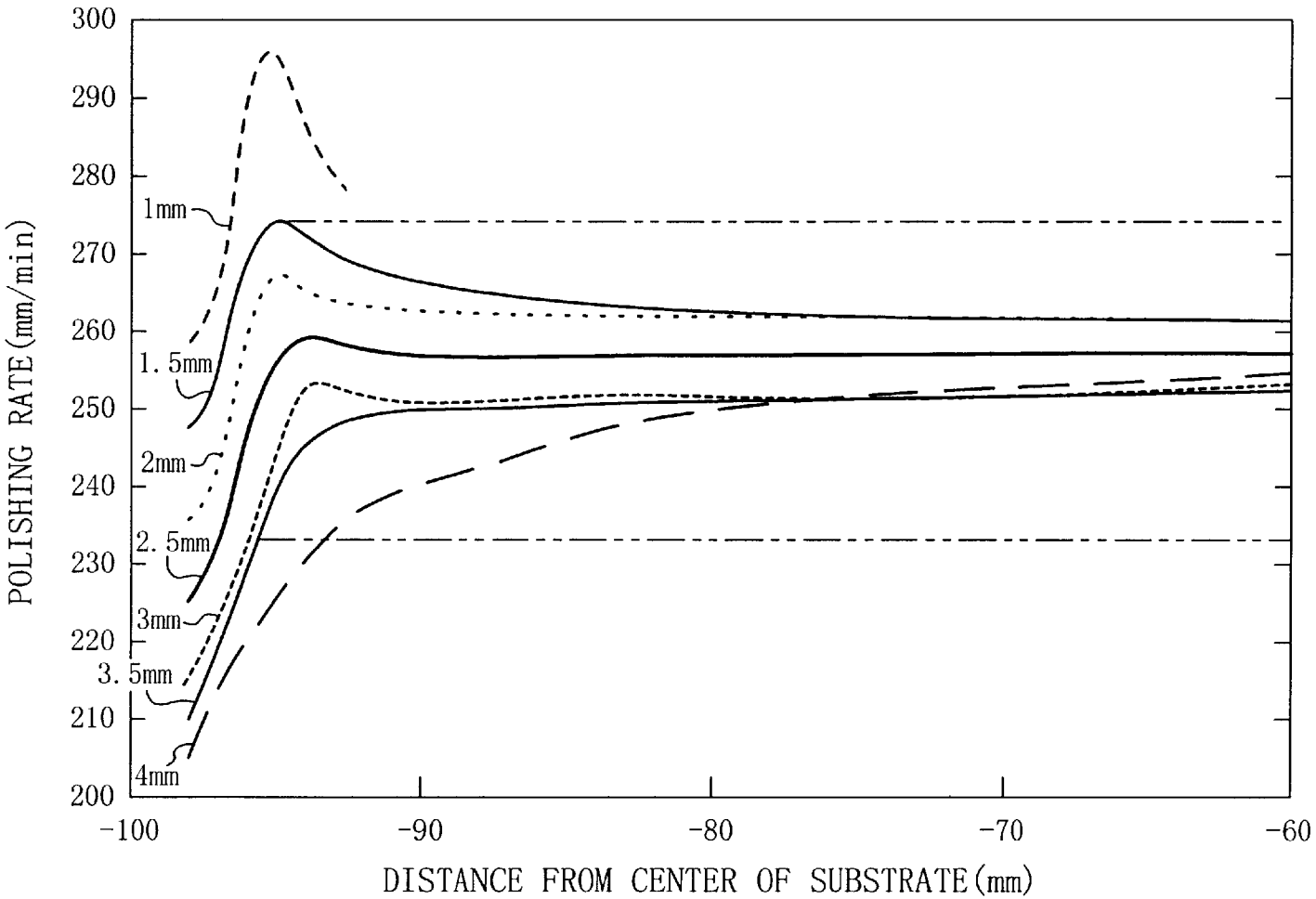
FIG. 8 is a graph illustrating how the polishing rate changes depending on the width of an outer edge region, which is included in a peripheral region of a substrate and not pressed by the seal member.

FIG. 8 illustrates how the polishing rate changes depending on the width of the outer edge region, which is included in the peripheral region of the substrate 5 and not pressed by the seal member 13. In FIG. 8, the distance between the outer edge of the substrate 5 and the guide member 14 is set at 150 $\mu$m. As can be seen from FIG. 8, if the width of the outer edge region of the substrate 5, which is not pressed by the seal member 13, is within the range from 1.5 mm to 3.5 mm, then the variation in polishing rate can be within 10% in a region of the substrate 5 inside a line about 5 mm inner to the outer edge of the substrate 5.

Embodiment 2

Figure 3:
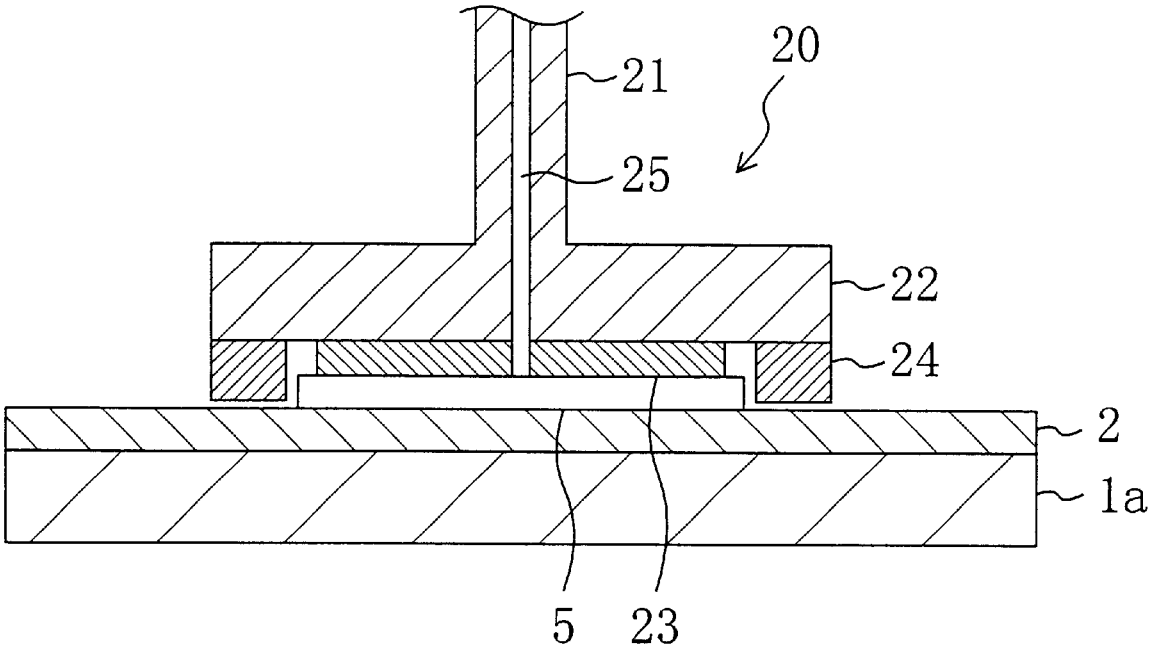
FIG. 3 is a cross-sectional view of a substrate holder according to a second embodiment of the present invention.

FIG. 3 illustrates a cross-sectional structure of a substrate holder 20 according to a second embodiment of the present invention. As shown in FIG. 3, the substrate holder includes a drive shaft 21, a disklike substrate-holding head 22, a back pad 23 made of an elastic body and a ringlike guide member 24. The substrate-holding head 22 is integrated with the drive shaft 21 at the lower end thereof. The back pad 23 is secured to the lower surface of the substrate-holding head 22. And the guide member 24 is secured around the outer periphery of the back pad 23 on the lower surface of the substrate-holding head 22. A fluid path 25 runs through the drive shaft 21 and substrate-holding head 22. In this configuration, if the pressure inside the fluid path 25 is reduced, then the substrate 5 is sucked onto the back pad 23. On the other hand, if the pressure inside the fluid path 25 is increased, then the substrate 5 is released from the back pad 23.

The mechanism according to the first embodiment is adapted to automatically equalize the pressure applied by the pressurized fluid that has been supplied into the space 16 with the pressure applied to the drive shaft 11 and substrate-holding head 12. On the other hand, the mechanism according to the second embodiment is adapted to transmit the pressure, which has been applied to the drive shaft 21 and substrate-holding head 22, to the substrate 5 via the back pad 23.

According to the second embodiment, the back pad 23 is secured to the lower surface of the substrate-holding head 22 so as to come into contact with the peripheral region of the substrate 5, except for its outer edge region. In the second embodiment, the "peripheral region" of the substrate 5 also means a ringlike region belonging to the surface of the substrate 5 except for its center region. The "outer edge region" of the substrate 5 also means a ringlike region, which is located slightly inside the outer edge of the substrate 5 and has a width of several millimeters.

Hereinafter, a method for polishing a substrate using the substrate holder 20 according to the second embodiment will be described with reference to FIGS. 4(*a*) through 4(*c*).

First, a transportation operation will be described. The substrate 5 or substrate holder 20 is moved horizontally over such a distance as to locate the substrate 5 under the substrate-holding head 22. Then, the substrate-holding head 22 is moved downward to come closer to the substrate 5. Thereafter, the pressure inside the fluid path 25 is reduced. As a result, the substrate 5 is sucked to, and held on, the substrate-holding head 22 via the back pad 23 as shown in FIG. 4(*a*). The substrate-holding head 22 is transported in such a state to be located over the polishing pad 2 that has been attached to the upper surface of the platen 1*a*.

Figure 4A:
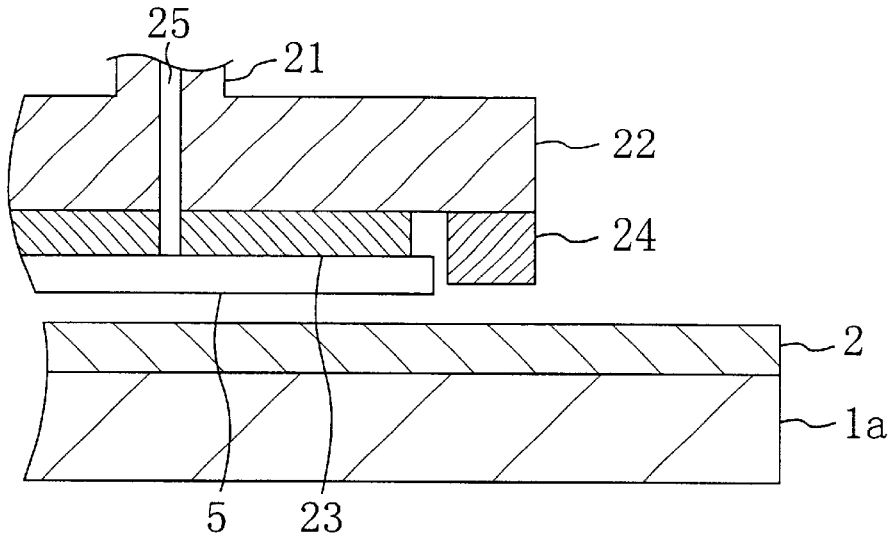
FIGS. 4(*a*), 4(*b*) and 4(*c*) are cross-sectional views illustrating respective process steps for polishing a substrate using the substrate holder according to the second embodiment.
Figure 4B:
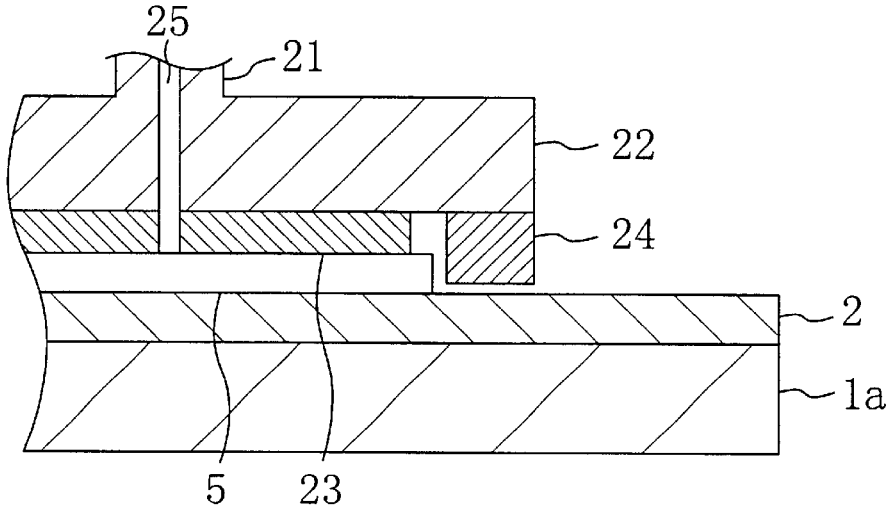
Figure 4C:
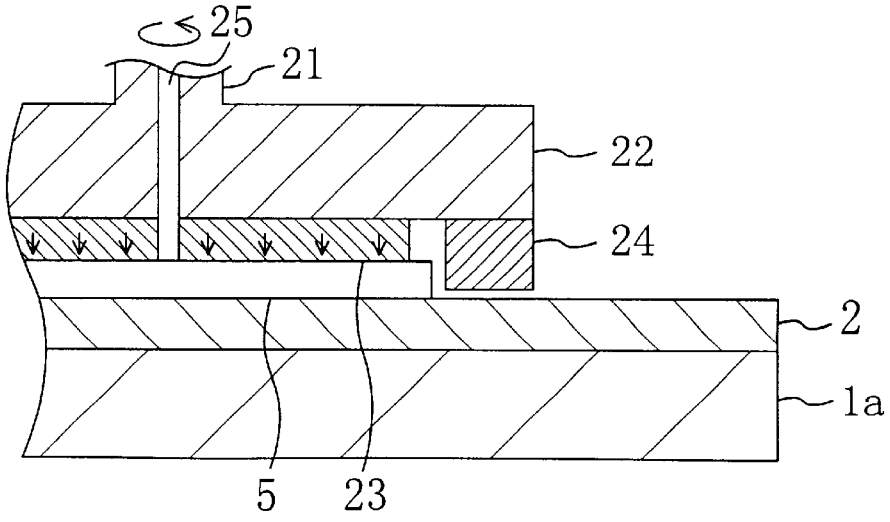

Next, as shown in FIG. 4(*b*), the pressure inside the fluid path 25 is restored to the atmospheric pressure, thereby releasing and mounting the substrate 5 on the polishing pad 2.

Subsequently, as shown in FIG. 4(*c*), the substrate-holding head 22 is pressed downward. At the same time, slurry, containing abrasive grains, is dripped onto the polishing pad 2, while the polishing pad 2 and substrate-holding head 22 are rotated relative to one another. Then, sliding friction is caused between the surface of the substrate 5 to be polished and the polishing pad 2 through the slurry. As a result, the surface of the substrate 5 to be polished has its roughness reduced little by little, and is finally planarized. The guide member 24 is used to prevent the substrate 5 from being ejected due to the centrifugal force involved with the rotation, thereby holding the substrate 5 in a predetermined position.

According to the second embodiment, the back pad 23 is secured to the lower surface of the substrate-holding head 22 so as to come into contact with the peripheral region of the substrate 5 except for its outer edge region. That is to say, the outer edge region of the substrate 5 is not directly pressed by the back pad 23. Thus, it is possible to prevent the outer edge region of the substrate 5 from receiving excessively high pressure from the polishing pad 2.

Accordingly, the substrate 5 receives substantially equal pressure from the polishing pad 2 over the entire surface thereof, i.e., in both of its center and peripheral regions alike. As a result, virtually the entire surface of the substrate 5 is polished at a substantially uniform rate.

Embodiment 3

Hereinafter, a method for fabricating a semiconductor device by utilizing the substrate polishing method according to the first or second embodiment will be described as a third embodiment of the present invention with reference to FIGS. 9(*a*) through 9(*c*).

Figure 9A:
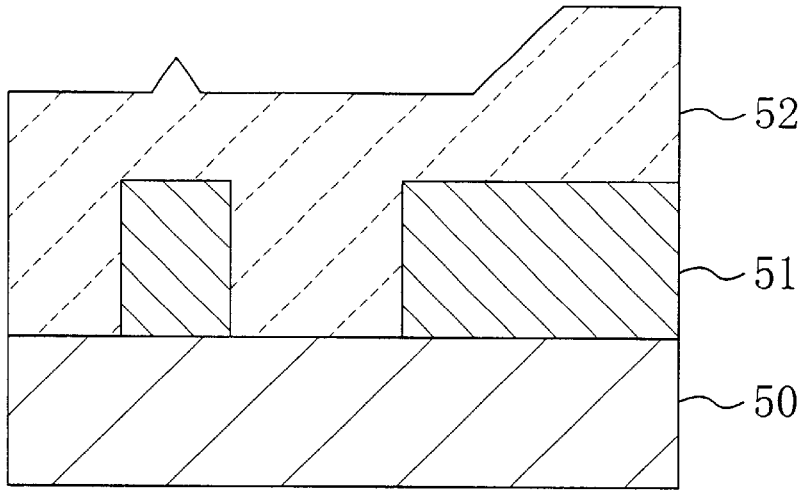
FIGS. 9(*a*), 9(*b*) and 9(*c*) are cross-sectional views illustrating respective process steps for fabricating a semiconductor device according to a third embodiment of the present invention.
Figure 9B:
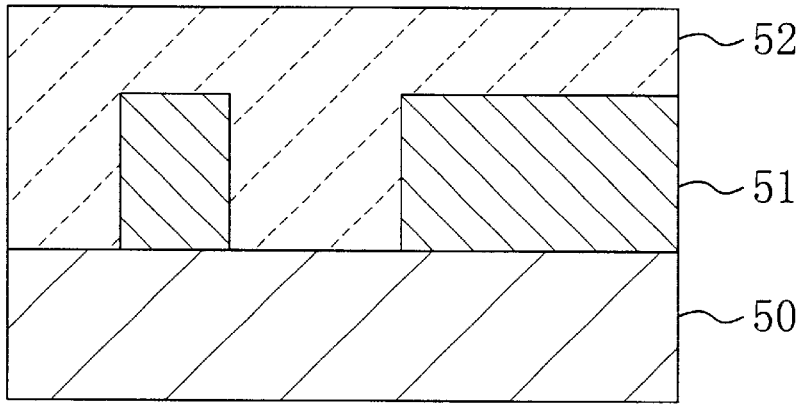
Figure 9C:
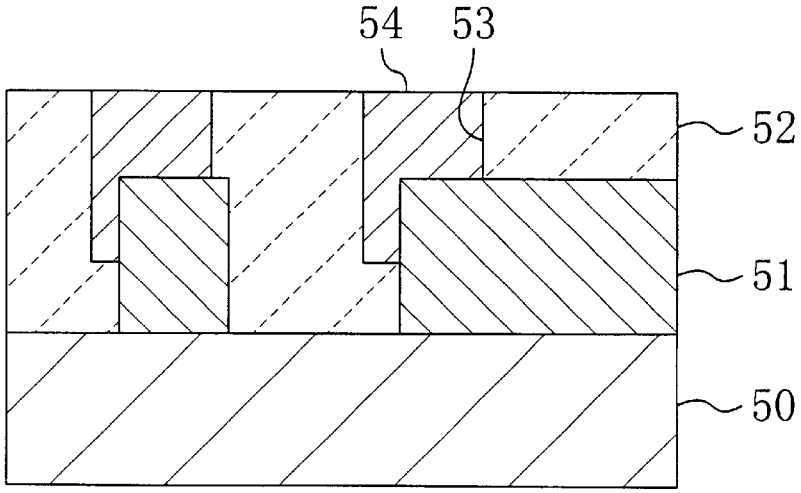

First, as shown in FIG. 9(*a*), metal interconnection lines 51 made of an aluminum alloy or copper are formed on a semiconductor wafer 50, on which semiconductor components have been formed. Then, an interlevel insulating film 52 of silicon dioxide, for example, is deposited by a high-density plasma CVD (HDP-CVD) process, for example, over the entire surface of the semiconductor wafer 50, as well as over the metal interconnection lines 51. Thereafter, the semiconductor wafer 50 is annealed if necessary.

Next, the interlevel insulating film 52 is chemically and mechanically polished in accordance with the substrate polishing method of the first or second embodiment, thereby planarizing the surface of the interlevel insulating film 52 as shown in FIG. 9(*b*). In the CMP process, silica slurry may be used as the abrasive, for example.

Then, as shown in FIG. 9(*c*), contact holes 53 are formed above the metal interconnection lines 51 in the interlevel insulating film 52. Thereafter, a tungsten film is deposited by a CVD process, for example, over the entire surface of the interlevel insulating film 52 so as to fill in the contact holes 53. Subsequently, portions of the tungsten film, which are exposed on the interlevel insulating film 52, are removed by an etchback technique, thereby forming contacts 54 out of the tungsten film.

According to the third embodiment, the interlevel insulating film 52 may be deposited by an SA-CVD technique, not the HDP-CVD technique.

Also, a metal film of aluminum or copper may be deposited instead of the tungsten film. Furthermore, those portions of the tungsten film that are exposed on the interlevel insulating film 52 may be removed by a CMP technique, not the etchback technique.

Embodiment 4

Hereinafter, a method for fabricating a semiconductor device by utilizing the substrate polishing method according to the first or second embodiment will be described as a fourth embodiment of the present invention with reference to FIGS. 10(*a*) through 10(*c*).

Figure 10A:
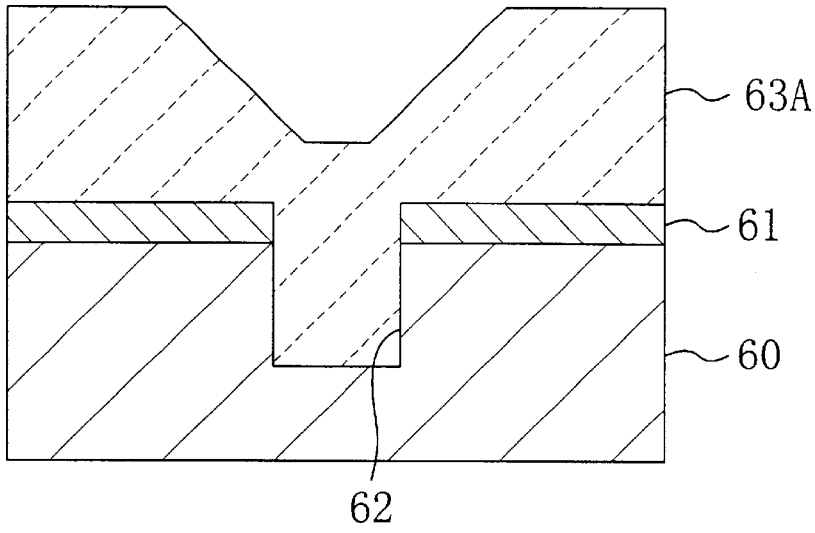
FIGS. 10(*a*), 10(*b*) and 10(*c*) are cross-sectional views illustrating respective process steps for fabricating a semiconductor device according to a fourth embodiment of the present invention.
Figure 10B:
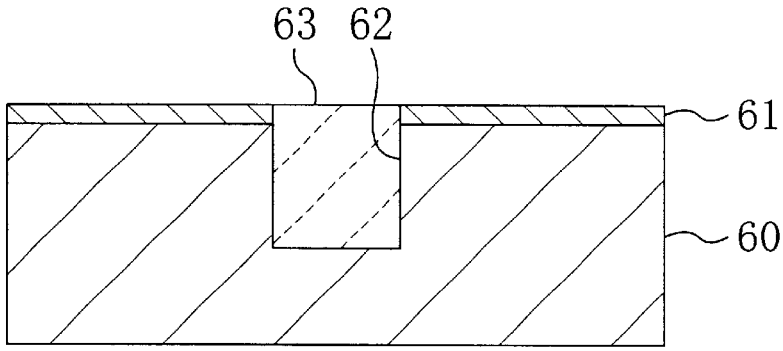
Figure 10C:
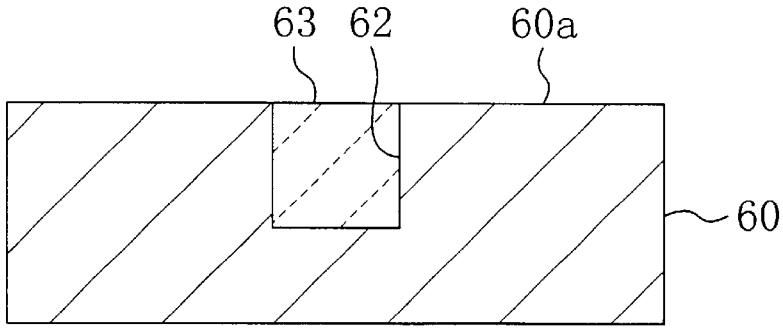

First, as shown in FIG. 10(*a*), an etch stopper film 61 of silicon nitride, for example, is deposited on a semiconductor wafer 60. Then, the stopper film 61 and semiconductor wafer 60 are selectively dry-etched to form trenches 62. Subsequently, a silicon dioxide film 63A is deposited by the HDP-CVD process, for example, over the entire surface of the semiconductor wafer 60 so as to fill in the trenches 62. Thereafter, the semiconductor wafer 60 is annealed if necessary.

Next, the silicon dioxide film 63A is chemically and mechanically polished in accordance with the substrate polishing method of the first or second embodiment. In this manner, portions of the silicon dioxide film 63A that are exposed on the stopper film 61 are removed to form a trench isolation film 63 out of the silicon dioxide film 63A as shown in FIG. 10(*b*). In the CMP process, silica or ceria slurry may be used as the abrasive, for example.

Then, as shown in FIG. 10(*c*), the stopper film 61 is removed and then an unnecessary insulating film (not shown) that is left on the semiconductor wafer 60 is also removed. In this process step, the trench isolation film 63 is also etched and the surface level thereof lowers. Thus, suppose the thickness of the stopper film 61 is set at an appropriate value at the end of the CMP process step of removing the portions of the silicon dioxide film 63A that are exposed on the stopper film 61 as shown in FIG. 10(*b*). Then, the surface of the active region 60*a* of the semiconductor wafer 60 and that of the trench isolation film 63 may have their desired shapes.

According to the fourth embodiment, the silicon dioxide film 63A may be deposited by an SA-CVD technique, not the HDP-CVD technique.

Also, a boron nitride film may be deposited as the stopper film 61 instead of the silicon nitride film.

Embodiment 5

Hereinafter, a method for fabricating a semiconductor device by utilizing the substrate polishing method according to the first or second embodiment will be described as a fifth embodiment of the present invention with reference to FIGS. 11(*a*) through 11(*c*).

Figure 11A:
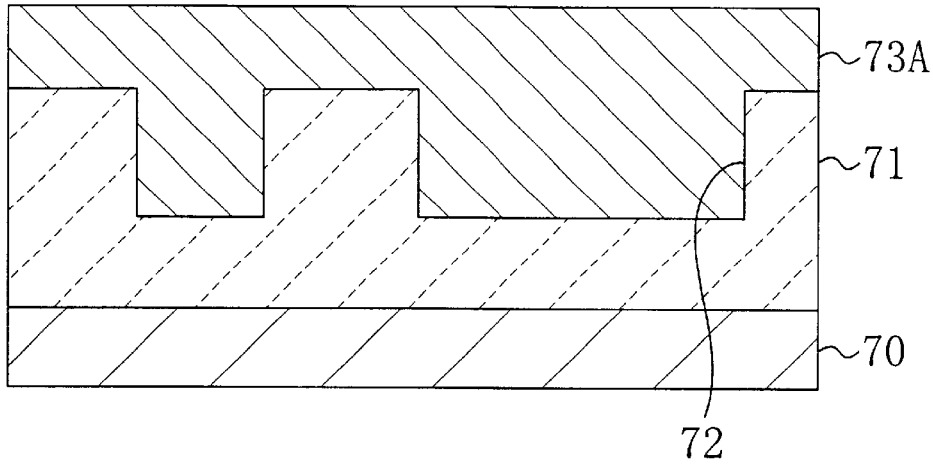
FIGS. 11(*a*), 11(*b*) and 11(*c*) are cross-sectional views illustrating respective process steps for fabricating a semiconductor device according to a fifth embodiment of the present invention.
Figure 11B:
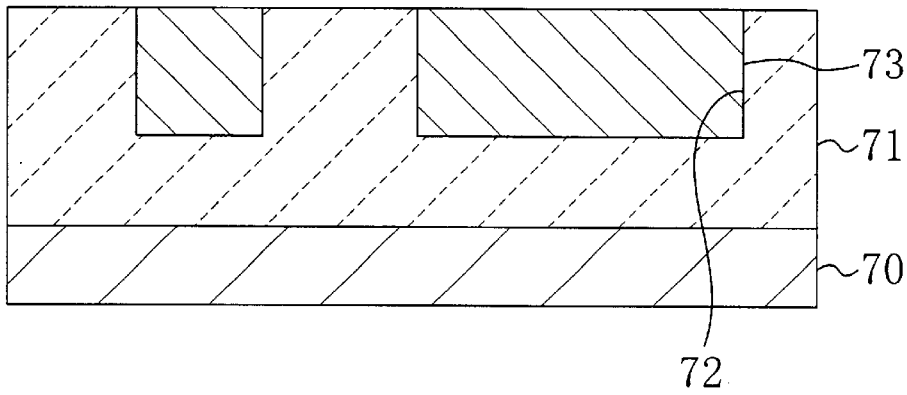
Figure 11C:
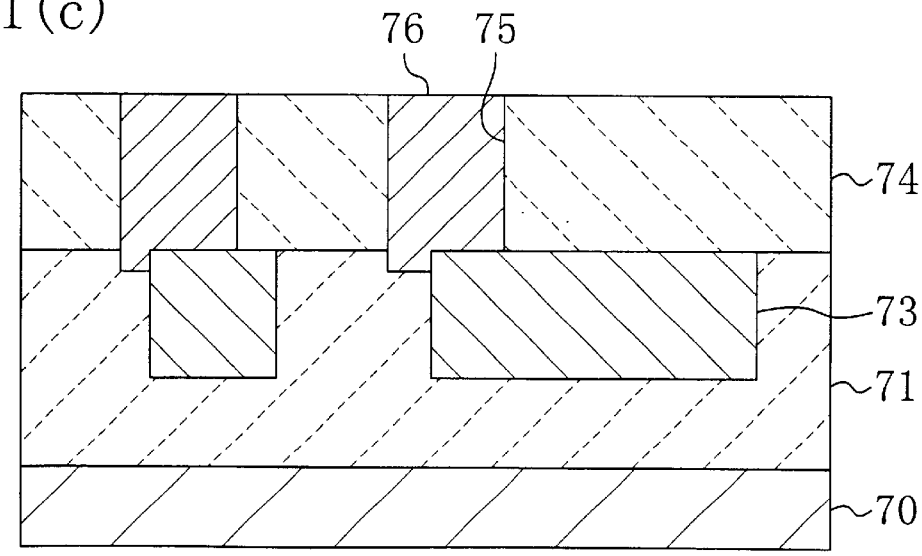

First, as shown in FIG. 11(*a*), a first interlevel insulating film 71 of silicon dioxide, for example, is deposited on a semiconductor wafer 70, on which semiconductor components have been formed. Then, interconnection channels 72 are formed in the first interlevel insulating film 71 by dry etching, for example. Subsequently, a metal film 73A of copper or an aluminum alloy is deposited over the entire surface of the first interlevel insulating film 71 so as to fill in the interconnection channels 72.

Next, the metal film 73A is chemically and mechanically polished in accordance with the substrate polishing method of the first or second embodiment, thereby removing portions of the metal film 73A that are exposed on the first interlevel insulating film 71. As a result, metal interconnection lines 73 are formed out of the metal film 73A as shown in FIG. 11(*b*). In this CMP process, silica, ceria or alumina slurry may be used as the abrasive, for example.

Then, as shown in FIG. 11(*c*), a second interlevel insulating film 74 of silicon dioxide, for example, is deposited over the entire surface of the first interlevel insulating film 71 as well as over the metal interconnection lines 73. Thereafter, contact holes 75 are formed above the metal interconnection lines 73 in the second interlevel insulating film 74. Thereafter, a tungsten film is deposited by a CVD process, for example, over the entire surface of the second interlevel insulating film 74 so as to fill in the contact holes 75. Subsequently, portions of the tungsten film, which are exposed on the second interlevel insulating film 74, are removed, thereby forming contacts 76 out of the tungsten film. In the process step of forming the contacts 76 out of the tungsten film, chemical/mechanical polishing may be performed in accordance with the substrate polishing method of the first or second embodiment.

What is claimed is:

1. A method for polishing a substrate by pressing the substrate against a polishing pad using a substrate holder which comprises:

a substrate-holding head including a fluid path which allows a pressurized fluid supplied from one end of the fluid path to flow out from the other end of the fluid path;

a seal member shaped like a ring which is secured to the substrate-holding head so as to surround the other end of the fluid path; and a guide member provided on an outer side of the seal member in the substrate-holding head, wherein a space is formed by the substrate disposed on the polishing pad, the substrate-holding head and the seal member, the method comprising the steps of:

pressing a central region of the substrate against the polishing pad using the pressurized fluid flowing out from the other end of the fluid path into the space;

pressing a peripheral region of the substrate except an outer edge region of the substrate against the polishing pad using the seal member; and guiding the substrate so as to prevent the substrate from going out, using the guide member while having the substrate polished by the polishing pad.

2. The method of claim 1, wherein a width of the outer edge region of the substrate is between 1.5 mm and 3.5 mm, inclusive.

3. The method of claim 1, wherein:

an interlevel insulating film is deposited over a surface of the substrate, which is to be in contact with the polishing pad;

the step of pressing the central region of the substrate against the polishing pad is performed by applying the pressurized fluid to a back face opposite to the surface of the substrate;

the step of pressing the peripheral region except the outer edge region of the substrate against the polishing pad is performed by applying the seal member to the back face of the substrate; and the method further comprises a step of planarizing the interlevel insulating film by having the interlevel insulating film polished by the polishing pad.

4. The method of claim 1, wherein:

the substrate includes a trench in a surface thereof;

an insulating film is formed over the surface of the substrate including the trench, which is to be in contact with the polishing pad;

the step of pressing the central region of the substrate is performed by applying the pressurized fluid to a back face opposite to the surface of the substrate;

the step of pressing the peripheral region except the outer edge region of the substrate is performed by applying the seal member tot the back face of the substrate; and the method further comprises a step of forming an isolation trench of the insulating film in the surface of the substrate by having the insulating film polished by the polishing pad.

5. The method of claim 1, wherein:

an insulating film having an interconnection groove is formed on a surface of the substrate;

a metal film is deposited over the insulating film including the interconnection groove, which is to be in contact with the polishing pad;

a metal film is deposited over the insulating film including the interconnection groove, which is to be in contact with the polishing pad;

the step of pressing the central region of the substrate is performed by applying the pressurized fluid to a back face opposite to the surface of the substrate;

the step of pressing the peripheral region except the outer edge region of he substrate is performed by applying the seal member to the back face of the substrate; and the method further comprises a step of forming a buried interconnection of the metal film by having the metal film polished by the polishing pad.

* * * * *